US008011432B2

(12) United States Patent
Langlais et al.

(10) Patent No.: US 8,011,432 B2
(45) Date of Patent: Sep. 6, 2011

(54) APPARATUS AND METHOD FOR INFLOW CONTROL

(75) Inventors: Michael D. Langlais, Houston, TX (US); Tage Thorkildsen, Raege (NO); Terje Moen, Sandnes (NO); Odd Rønnestad, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 180 days.

(21) Appl. No.: 12/367,072

(22) Filed: Feb. 6, 2009

(65) Prior Publication Data

US 2009/0218101 A1 Sep. 3, 2009

Related U.S. Application Data

(60) Provisional application No. 61/026,488, filed on Feb. 6, 2008.

(51) Int. Cl.
*E21B 43/00* (2006.01)

(52) U.S. Cl. ..... 166/278; 166/229; 166/236

(58) Field of Classification Search ..... 166/53, 166/227, 229, 236, 242.1, 278
See application file for complete search history.

(56) References Cited

U.S. PATENT DOCUMENTS

| | | | | |
|---|---|---|---|---|
| 7,762,341 | B2 * | 7/2010 | Hammer | 166/370 |
| 7,789,152 | B2 * | 9/2010 | Langeslag | 166/296 |
| 7,832,473 | B2 * | 11/2010 | Pensgaard | 166/193 |
| 2007/0246212 | A1 * | 10/2007 | Richards | 166/227 |
| 2008/0169099 | A1 * | 7/2008 | Pensgaard | 166/285 |
| 2008/0236843 | A1 * | 10/2008 | Scott et al. | 166/386 |
| 2009/0000757 | A1 * | 1/2009 | Colon | 164/137 |
| 2009/0101329 | A1 * | 4/2009 | Clem et al. | 166/66.6 |
| 2009/0151925 | A1 * | 6/2009 | Richards et al. | 166/53 |

* cited by examiner

*Primary Examiner* — William P Neuder
(74) *Attorney, Agent, or Firm* — David G. Matthews; Rodney V. Warfford; Tim Curington

(57) ABSTRACT

An inflow control assembly. The inflow control assembly can include an inner tubular member comprising a hole formed therethrough. A cover assembly can encircle the hole. The cover assembly can include a first outer member disposed about at least a portion of the inner tubular member. The first outer member can be secured to the inner tubular member. A second outer member can be disposed about at least a portion of the inner tubular member, and the second outer member can be secured to the inner tubular member. A screen portion can be disposed between the outer members and between the inner tubular member and the outer members. An annulus can be formed between the outer members and the inner tubular member, and the annulus can provide a flow path between the hole and the screen portion.

14 Claims, 2 Drawing Sheets

APPARATUS AND METHOD FOR INFLOW CONTROL

CROSS-REFERENCE TO RELATED APPLICATIONS

This application claims priority to U.S. Provisional Patent Application having Ser. No. 61/026,488, filed on Feb. 6, 2008, which is incorporated by reference herein.

BACKGROUND

A wellbore typically passes through various hydrocarbon bearing reservoirs or extends through a single reservoir for a relatively long distance. A technique to increase the production of the well is to perforate the well in a number of different hydrocarbon bearing zones. However, an issue associated with producing from a well in multiple hydrocarbon bearing zones is the control of the flow of fluids from the wellbore into a completion assembly. For example, in a well producing from a number of separate hydrocarbon bearing zones, one hydrocarbon bearing zone can have a higher pressure than another hydrocarbon bearing zone. Without proper management, the higher pressure hydrocarbon bearing zone produces into the lower pressure hydrocarbon bearing zone rather than to the surface.

Similarly, in a horizontal well, hydrocarbon bearing zones near the "heel" of the well (closest to the vertical or near vertical part of the well) may begin to produce unwanted water or gas (referred to as water or gas coning) before those zones near the "toe" of the well (furthest away from the vertical or near vertical departure point) begin producing unwanted water or gas. Production of unwanted water or gas in any one of these hydrocarbon bearing zones may require special interventions to stop production of the unwanted water or gas.

There is a need, therefore, for an apparatus and methods for preventing unwanted water or gas production.

SUMMARY

Apparatus and methods for inflow control of produced hydrocarbons are provided. The apparatus can include an inner tubular member comprising a hole formed therethrough. A cover assembly can encircle the hole. The cover assembly can include a first outer member disposed about at least a portion of the inner tubular member. The first outer member can be secured to the inner tubular member. A second outer member can be disposed about at least a portion of the inner tubular member, and the second outer member can be secured to the inner tubular member. A screen portion can be disposed between the outer members and between the inner tubular member and the outer members. An annulus can be formed between the outer members and the inner tubular member, and the annulus can provide a flow path between the hole and the screen portion.

In one or more embodiments, the method for the inflow control of produced hydrocarbons can include conveying a system for downhole fluid control into a wellbore. The wellbore can have at least a first hydrocarbon bearing zone and a second hydrocarbon bearing zone. The inflow control system can include a first packer, second packer and a third packer disposed about tubing. A first apparatus for inflow control of produced hydrocarbons can be connected to the tubing between the first packer and the second packer, and a second apparatus for inflow control of produced hydrocarbons can be connected to the tubing between the second packer and the third packer. The first apparatus for inflow control of produced hydrocarbons can be located adjacent the first hydrocarbon bearing zone, and the second apparatus for inflow control can be located adjacent the second hydrocarbon bearing zone. The first zone and second zone can be isolated from one another and hydrocarbons can be produced from the first hydrocarbon bearing zone through the first apparatus for inflow control to the surface.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
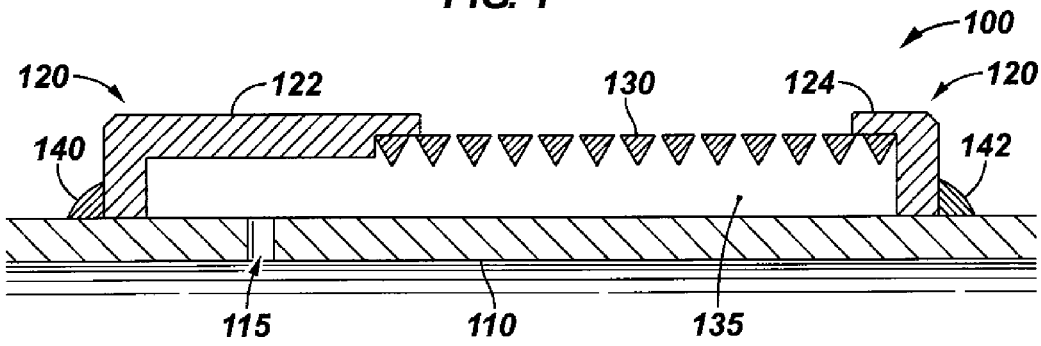
FIG. 1 depicts a cross-section view of an illustrative embodiment of an inflow control assembly, according to one or more embodiments described.

FIG. 1 depicts a cross-section view of an illustrative embodiment of an inflow control assembly 100, according to one or more embodiments. The inflow control assembly 100 can include one or more inner tubular members 110 having one or more holes 115 formed therethrough, and one or more cover assemblies 120 disposed about the exterior of the inner tubular member 110.

The inner tubular member 110 can be used to produce hydrocarbons from a wellbore to the surface. For example, the inner tubular member 110 can be a base pipe or other common downhole tubular member. The inner tubular member 110 can be configured to connect to other downhole tubulars, for example, by threaded connection. The inside of the inner tubular member 110 can be in communication with a wellbore through the one or more holes 115.

The one or more holes 115 can be formed about the inner tubular member 110 in any pattern. The inner tubular member 110 can have any number, including but not limited to, one, two, three, four, ten, fifteen, or more holes 115 formed therethrough. The one or more holes 115 can have any cross section shape, such as circular, rectangular, square, or other shapes. The one or more holes 115 can allow hydrocarbons from the wellbore to flow into the inner tubular member 110. The one or more holes 115 can have an inner diameter of any size. For example, the one or more holes 115 can have an inner diameter ranging from about 1 mm-10 mm or more. The size of the one or more holes 115 and the number of the one or more holes 115 can be varied or sized to ensure a required pressure drop therethrough. In one or more embodiments, the one or more holes 115 can be formed as a nozzle, as depicted in FIG. 1 or one or more holes 215 can be formed as plain holes configured to receive one or more nozzle inserts 218.

The cover assembly 120 can be disposed about the inner tubular member 110 and can protect the one or more holes 115. The cover assembly 120 can include a first outer member 122, a second outer member 124, and a screen portion 130. The outer members 122, 124 can be disposed about the outer diameter of the inner tubular member 110. The first outer member 122 can be a solid housing, an end ring, a solid member, a tubular, or similar member. The first outer member 122 can encircle the one or more holes 115. Accordingly, the first outer member 122 prevents debris or unfiltered fluid from entering or engaging the one or more holes 115. The second outer member 124 can be a tubular, an end ring, or a similar member. The outer members 122, 124 can be disposed about the inner tubular member 110, and the outer members 122, 124 can be used to secure or hold the screen portion 130 about the inner tubular member 110. The outer members 122, 124 can be connected to the exterior of the inner tubular member 110. For example, the outer members 122, 124 can be secured to the inner tubular member 110 by welds 140, 142 respectively.

The screen portion 130 can be disposed between the first outer member 122 and the second outer member 124. In addition, the screen portion 130 can be disposed between the inner tubular member 110 and the outer members 122, 124. For example, the screen portion 130 can be at least partially disposed within the inner portion of the outer members 122, 124 and about the outer diameter of the inner tubular member 110. Accordingly, the screen portion 130 can be trapped or contained by the outer members 122, 124 and the inner tubular member 110.

The screen portion 130 can be used to filter hydrocarbons or other fluids produced from the well, and can prevent debris above a certain size from entering the one or more holes 115. The screen portion 130 can be or include wire-wrapped jacket filter media, mesh type jacket filter media, or another type of filter media capable of preventing debris above a certain size from passing therethrough. For example, the filter media can be configured for use in carbonate wells.

In one or more embodiments, the sand screen portion 130 can have a filtering slot size. The filtering slot size can vary depending on the well type or the desired size of debris to be filtered. By way of example only, the filtering slot size can be up the inner diameter of the one or more holes 115 or one or more of nozzle insert 218.

The outer members 122, 124 and the screen portion 130 can be disposed about the inner tubular member 110 such that an annulus 135 is formed therebetween. The annulus 135 can be closed off by the outer members 122, 124 and the inner tubular member 110. Accordingly, the screen portion 130 and the one or more holes 115 are the only inlet and/or outlets of the annulus 130. As such, no debris or unfiltered fluid can enter the annulus 135, and the one or more holes 115 can be protected from clogging or other adverse affects caused by debris or unfiltered fluids.

Figure 2:
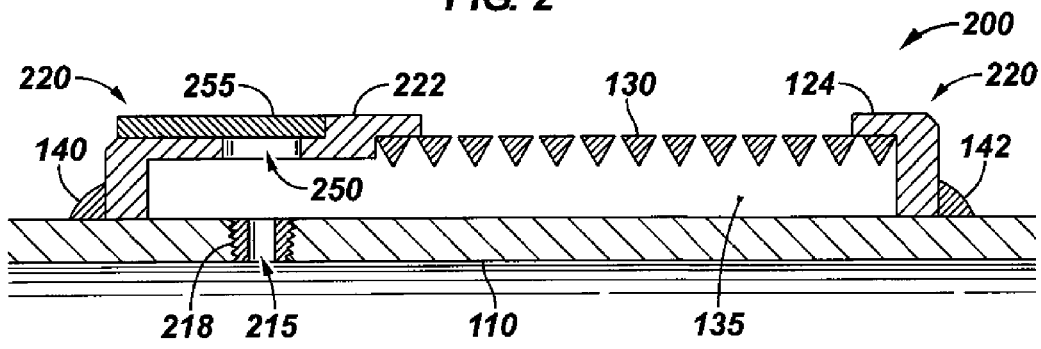
FIG. 2 depicts a cross-section view of an illustrative embodiment of another inflow control assembly, according to one or more embodiments described.

FIG. 2 depicts a cross-section view of an illustrative embodiment of another inflow control assembly 200, according to one or more embodiments. The inflow control assembly 200 can include a cover assembly 220 disposed about the inner tubular member 110. The inner tubular member 110 can have one or more holes 215 formed therethrough. The arrangement of the one or more holes 215 about the inner tubular member 110, the size and shape of the one or more holes 215, and the number of the one or more holes 215 can be similar to as described above in regards to the one or more holes 115. The one or more holes 215 can be formed as plain holes configured to receive one or more nozzle inserts 218. For example, the one or more holes 215 can be threaded for receiving a threaded nozzle insert 218; configured to form a pressure fit with the nozzle insert 218; or configured to connect to the nozzle insert 218 with a mechanical fastener. The nozzle insert 218 can be configured to cause or produce the appropriate pressure drop through the one or more holes 215, controlling the flow rate of hydrocarbons from the wellbore into the inner tubular member 110.

The cover assembly 220 can include a first outer member 222 and the second outer member 124. Furthermore, the screen portion 130 can be disposed between the outer members 222, 124. The first outer member 222 can encircle the one or more holes 215 and protect the one or more holes 215 from debris or unfiltered fluid. The first outer member 222 can be similar to the first outer member 122 of FIG. 1. The first outer member 222 can also have a selectively closable aperture or opening 250 formed therethrough.

The aperture 250 can allow access to the one or more holes 215 even after the cover assembly 220 is secured to the inner tubular member 110. The aperture 250 can be selectively opened by the removal or rotation of a removable cover 255. The removable cover 255 can be a hinged plate, a removable plate, or a sliding member. For example, to close the aperture 250 the removable cover 255 can be placed about the aperture 250 and can be bolted to the first outer member 222. When the removable cover 255 is disposed about the aperture 250, the removable cover 255 can block or close the aperture 250, protecting the one or more holes 215 from debris or unfiltered fluid. If access to the one or more holes 215 or annulus 135 is desired the cover 255 can be removed from the aperture 250, allowing access to the annulus 135 or the one or more holes 215 via aperture 250.

Figure 3:
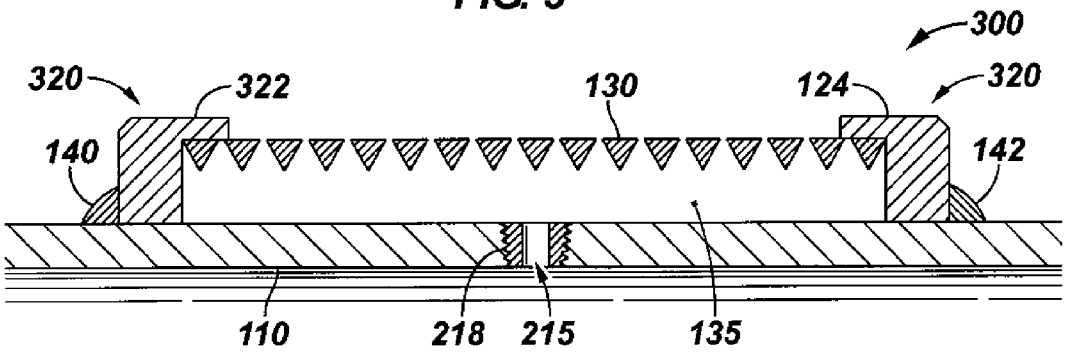
FIG. 3 depicts a cross-section view of an illustrative embodiment of yet another inflow control assembly, according to one or more embodiments described.

FIG. 3 depicts a cross-section view of an illustrative embodiment of yet another inflow control assembly 300, according to one or more embodiments. The inflow control assembly 300 can include the inner tubular member 110 with one or more holes 215, having one or more nozzle inserts 218, formed therethrough. A cover assembly 320 can be disposed about the inner tubular member 110.

The cover assembly 320 can include outer members 322, 124. Each of the outer members 322, 124 can be end rings. The outer members 322, 124 can be connected to the inner tubular member 110, for example by welds 140, 142 respectively. The outer members 322, 124 and the inner tubular member 110 can hold the screen portion 130 in place. The screen portion 130 can be disposed about the one or more holes 215, protecting the one or more holes 215 from debris or unfiltered fluids.

The inflow control assemblies 100, 200, 300 can be manufactured independent of sand completion assemblies or other completion assemblies. The manufacture of the inflow control assemblies 100, 200, 300 will be discussed with reference to the inflow control assembly 100. The inflow control assembly 100 can be created by forming one or more holes 115 into an inner tubular member 110. The outer members 122, 124 can be axially spaced a distance from one another and disposed about the inner tubular member 110. The outer members 122, 124 can be secured to the inner tubular member 110. For example, the outer members 122, 124 can be welded to the inner tubular member 110. The screen portion 130 can be configured to fit between the outer members 122, 124. Furthermore, the screen portion 130 can be configured to be disposed between the inner tubular member 110 and the outer members 122, 124. For example, the screen portion 130 can be configured to fit properly between the outer members 122, 124 by cutting a screen jacket having a length of approximately thirty-six feet to eighteen screen jackets having a length of approximately two feet. After the screen portion 130 is configured to fit properly between the outer members 122, 124 the screen portion 130 can be placed between the outer members 122, 124 and the inner tubular member 110. Accordingly, the screen portion 130 is held in place by the outer members 122, 124 and the inner tubular member 110, and the screen portion 130 does not need to be welded to the inner tubular member 110.

Figure 4:
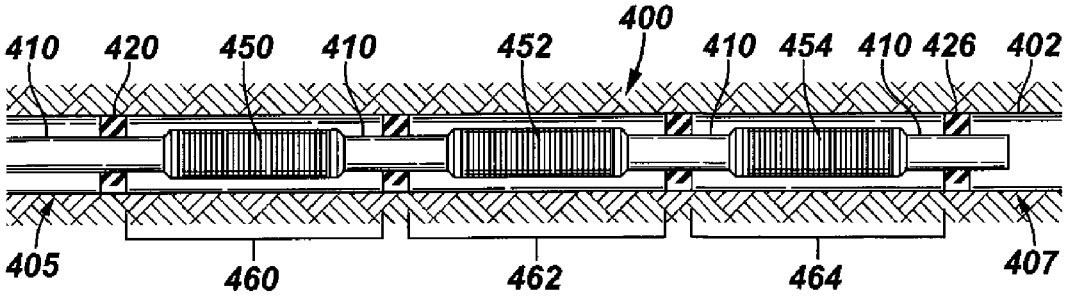
FIG. 4 depicts a schematic view of a completion system having multiple inflow control assemblies installed in a horizontal wellbore, according to one or more embodiments described.

FIG. 4 depicts a schematic view of a completion system 400 having one or more inflow control assemblies (three are shown 450, 452, 454) installed in a horizontal wellbore 402, according to one or more embodiments. A tubing string 410 can be connected to each inflow control assembly 450, 452, 454. The tubing string 410 can provide fluid communicate between the inflow control assemblies 450, 452, 454 and the surface.

For clarity and ease of description, the operation of the completion system 400 will be further described with reference to a horizontal wellbore 402 having a "left" or first hydrocarbon bearing zone 460, a "middle" or second hydrocarbon bearing zone 462, and a "right" or third hydrocarbon bearing zone 464. The horizontal wellbore 402 has a heel 405 and a toe 407. The first hydrocarbon bearing zone 460 is adjacent the heel 405, and the third hydrocarbon bearing zone 464 is adjacent the toe 407. The completion system 400 can be equally effective or useful in a vertical wellbore, deviated wellbore, multi-lateral wellbore, or any other wellbore having one or more zones.

As used herein, the terms "up" and "down"; "upper" and "lower"; "upwardly" and "downwardly"; "upstream" and "downstream"; and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

One or more packers (four are shown 420, 422, 424, 426) can be disposed about the completion system 400. The packers 420, 422, 424, 426 can be disposed about the completion system 400 to isolate the first hydrocarbon bearing zone 460 from the second hydrocarbon bearing zone 462 and to isolate the second hydrocarbon bearing zone 462 from the third hydrocarbon bearing zone 464. Accordingly, the first hydrocarbon bearing zone 460, the second hydrocarbon bearing zone 462, and the third hydrocarbon bearing zone 464 can be produced and/or treated independent of one another. It is also possible to produce and/or treat the first hydrocarbon bearing zone 460, the second hydrocarbon bearing zone 462, and the third hydrocarbon bearing zone 464 at the same time. The packers 420, 422, 424, 426 can include any type of packer capable of sealing off an annulus between the completion system 400 and the wellbore 402. Illustrative packers 420, 422, 424, 426 can include compression or cup packers, inflatable packers, "control line bypass" packers, polished bore retrievable packers, other common downhole packers, or combinations thereof.

The inflow control assemblies 450, 452, 454 can be similar or substantially similar to any of the inflow control assemblies 100, 200, 300 as described herein. The inflow control assemblies 450, 452, 454 can control the flow of fluid from the wellbore 402 into the tubing 410. Accordingly, the inflow control assemblies 450, 452, 454 can be used to manage the flow of hydrocarbons from the wellbore 402 to prevent premature water or gas coning. Furthermore, the inflow control assemblies 450, 452, 454 can also be used during injection operations to control the injection of treatment fluid from within the tubing 410 to the wellbore 402. The term "treatment fluid" includes any fluid delivered to a formation to stimulate production including, but not limited to, fracing fluid, acid, gel, foam or other stimulating fluid. The inflow control assemblies 450, 452, 454 can be integrated with the tubing 410 by threading the inflow control assemblies 450, 452, 454 thereto.

In operation, the completion system 400 can be conveyed into the wellbore 402 to an appropriate position. The packers 420, 422, 424, 426 can be located within the wellbore 402 to isolate the hydrocarbon bearing zones 460, 462, 464 from one another. Once the packers 420, 422, 424, 426 are located within the wellbore 402 the packers 420, 422, 424, 426 can be set.

Furthermore, the inflow control assemblies 450, 452, 454 can be spaced such that the inflow control assemblies 450, 452, 454 are located adjacent the hydrocarbon bearing zones 460, 462, 464, when the packers 420, 422, 424, 426 are located in the wellbore 402 to isolate the hydrocarbon bearing zones 460, 462, 464 from one another. Of course, it is possible that one or more hydrocarbon bearing zones 460, 462, 464 will have no inflow control assembly or that one or more hydrocarbon bearing zones 460, 462, 464 will have more than one inflow control assembly. The number of inflow control assemblies 450, 452, 454 within each hydrocarbon bearing zone 460, 462, 464 of the wellbore 402 can be determined by the pressure differential between each hydrocarbon bearing zone 460, 462, 464 and the particular requirements of the wellbore 402. The inflow control assemblies 450, 452, 454 can ensure that the flow of hydrocarbons or treatment fluid is regulated and that problems commonly associated with pressure drops between the different hydrocarbon bearing zones 460, 462, 464 is not encountered.

After the inflow control assemblies 450, 452, 454 are properly located within the wellbore 402 and the packers 420, 422, 424, 426 are set, treatment can be applied to the hydrocarbon bearing zones 460, 462, 464 by flowing fluid from the surface through the tubing 410 and injecting the fluid to one or more of the hydrocarbon bearing zones 460, 462, 464 through one or more of the inflow control assemblies 450, 452, 454. Furthermore, hydrocarbons can be produced before or subsequent to the treatment operations. As such, produced hydrocarbons can flow from the wellbore 402 through the inflow control assemblies 450, 452, 454 into the tubing 410.

As depicted, the first hydrocarbon bearing zone 460 is adjacent the heel 405, and the third hydrocarbon bearing zone 464 is adjacent the toe 407. During production, the pressure drop at the heel 405 tends to be larger than the pressure drop at the toe 407, which can result in a greater production rate at the heel 405 than at the toe 407. To prevent an unequal production rate between the hydrocarbon bearing zones 460, 462, 464, the inflow control assemblies 450, 452, 454 can be configured to independently provide the necessary pressure drop in the associated hydrocarbon bearing zones 460, 462, 464. Accordingly, the inflow control assemblies 450, 452, 454 can prevent unequal production from the hydrocarbon bearing zones 460, 462, 464 and prevent any other adverse affects associated with large pressure differences between hydrocarbon bearing zones 460, 462, 464 from occurring.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An inflow control assembly comprising:

an inner tubular member comprising a hole formed therethrough;

a cover assembly encircling the hole, the cover assembly comprising:

a first outer member disposed about at least a portion of the inner tubular member; wherein the first outer member is secured to the inner tubular member;

a second outer member disposed about at least a portion of the inner tubular member, wherein the second outer member is secured to the inner tubular member;

a screen portion disposed between the outer members and between the inner tubular member and the outer members; and an annulus formed between the outer members and the inner tubular member, wherein the annulus provides a flow path between the hole and the screen portion.

2. The inflow control assembly of claim 1, wherein the hole comprises a nozzle.

3. The inflow control assembly of claim 1, further comprising an aperture formed through the first outer member, wherein the aperture is configured to be selectively closed.

4. The inflow control assembly of claim 1, wherein the outer members are welded to the inner tubular member.

5. The inflow control assembly of claim 1, wherein the outer members are end rings.

6. The inflow control assembly of claim 1, wherein the screen portion comprises a filtering slot size, wherein the hole has an inner diameter, and wherein the filtering slot size is less than the inner diameter of the hole.

7. The inflow control assembly of claim 1, wherein the hole comprises a nozzle insert threaded therein.

8. A method for controlling production rates between multiple hydrocarbon bearing zones, the method comprising:

conveying a system for downhole fluid control into a wellbore having at least a first hydrocarbon bearing zone and a second hydrocarbon bearing zone, the inflow control system comprising:

tubing;

a first packer, a second packer, and a third packer disposed about the tubing;

at least one inflow control assembly disposed between the first packer and the second packer, and at least a second inflow control assembly disposed between the second packer and the third packer, the inflow control assemblies comprising:

an inner tubular member comprising a hole formed therethrough;

a cover assembly encircling the hole, the cover assembly comprising:

a first outer member disposed about at least a portion of the inner tubular member; wherein the first outer member is secured to the inner tubular member;

a second outer member disposed about at least a portion of the inner tubular member, wherein the second outer member is secured to the inner tubular member;

a screen portion disposed between the outer members and between the inner tubular member and the outer members; and an annulus formed between the outer members and the inner tubular member, wherein the annulus provides a flow path between the hole and the screen portion;

locating the first inflow control assembly adjacent the first hydrocarbon bearing zone;

locating the second inflow control assembly adjacent the second hydrocarbon bearing zone;

isolating the first zone from the second zone; and producing hydrocarbons from at least the first hydrocarbon bearing zone.

9. The method of claim 8, wherein the outer members are end rings.

10. The method of claim 8, further comprising producing hydrocarbons from the second hydrocarbon bearing zone.

11. The method of claim 8, further comprising treating the first hydrocarbon bearing zone.

12. The method of claim 11, further comprising treating the first and second hydrocarbon bearing zones at the same time.

13. The method of claim 8, wherein isolating the hydrocarbon bearing zone from one another comprises setting the first packer, the second packer, and the third packer.

14. The method of claim 8, wherein the wellbore is a horizontal wellbore, and wherein the first hydrocarbon bearing zone is adjacent a heel of the wellbore and the second hydrocarbon bearing zone is adjacent the toe of the wellbore.

* * * * *